US005318276A

United States Patent [19]

Grenz et al.

[11] Patent Number: 5,318,276

[45] Date of Patent: Jun. 7, 1994

[54] APPARATUS FOR CONVEYING ROLLED STOCK WOUND INTO COILS IN THE REELING INSTALLATION AREA

[75] Inventors: Günter Grenz, Meerbusch; Mathias Eschweiler, Mettmann, both of Fed. Rep. of Germany

[73] Assignee: SMS Schloemann Siemag Aktiengesellschaft, Dusseldorf, Fed. Rep. of Germany

[21] Appl. No.: 50,928

[22] Filed: Apr. 21, 1993

[30] Foreign Application Priority Data

Apr. 24, 1992 [DE] Fed. Rep. of Germany ..... 4213459

[51] Int. Cl.[5] ..... C21D 9/56

[52] U.S. Cl. ..... 266/106; 266/112

[58] Field of Search ..... 266/102, 103, 106, 112, 266/249, 274

[56] References Cited

U.S. PATENT DOCUMENTS 4,401,294 8/1983 Ammerling et al. ..... 266/112
4,641,512 2/1987 Duri ..... 266/106
4,644,773 2/1987 Duri ..... 266/106

FOREIGN PATENT DOCUMENTS 2015046 10/1991 Fed. Rep. of Germany .

*Primary Examiner*—Scott Kastler
*Attorney, Agent, or Firm*—Anderson Kill Olick & Oshinsky

[57] ABSTRACT

An apparatus for delivery of rolled stock wound into coils, especially of wire from a reel-up device and for transfer of the rolled stock coils onto conveyance arrangements located downstream, wherein the reel-up and conveyance arrangements are installation components of a rolling mill with one or more rolling lines for wire, light or medium section steel, which essentially comprises a furnace installation for the rolling stock used, as well as a breakdown train, intermediate train and, if necessary, a finishing train for the rolling stock. The delivery and transfer apparatus may be provided with a liftable, as well as horizontally displaceable support panel, which can also be swiveled in a carousel-like manner for the wound rolled stock coils and one or more reeling arrangements and one or more conveyance arrangements may be disposed in the peripheral region of the swiveling path of the support panel.

9 Claims, 2 Drawing Sheets

APPARATUS FOR CONVEYING ROLLED STOCK WOUND INTO COILS IN THE REELING INSTALLATION AREA

FIELD OF THE INVENTION

The present invention deals with an apparatus for delivery of rolled stock wound into coils, especially of wire from a reeling installation and for transfer of the rolled stock coils to downstream conveyance arrangements.

BACKGROUND OF THE INVENTION

Rolling mills for wire, light section steel or medium section steel typically comprise a plurality of high quality installation components. A wire rolling train, with one or more lines, comprises a support grate for the rolling stock used mostly in the form of billets and a furnace where the billets are heated to rolling temperature. The billets are fed from the furnace to a break-down train comprising several rolling stands, permitting a twist-free rolling process. The stands in the break down train are equipped with load cells, measuring the roll separating force in order to better control rolling of difficult to shape high quality steels.

The intermediate train following the break-down train also comprises several rolling stands, for instance, of compact stands, which permit using roll barrels with high useful lives. A finishing train is located after the intermediate train, which can consist of a ten stand finishing block designed for maximum rolling speeds of up to 90 m/sec and above. Apart from the first two stands in the break-down train where box passes are used, the rolling stock is deformed exclusively in oval and round passes. The average reduction amounts, for instance, in the break-down train to approximately 24%, in the intermediate train to approximately 23%, in the finishing train to approximately 16%. The average reduction when rolling stock with a round diameter of, for instance, 5.5 mm from 120 mm, stock rolled to have a circular cross-section is wound into coils. The conveyance of the rolled stock coils from the reeling arrangement is performed onto a conveyance arrangement and, from there, on a hook conveyor, where the rolled stock is subjected to further cooling. Subsequently the rolled stock coils are shipped.

A wire reeling arrangement with a delivery device for a reeled-up rolled stock coil is described in DE 37 23 461 Al. The wire reeling arrangement has a coil shoulder lifting plate, which can be moved up and down by a central lifting rod in direction of the central axis of the reeling basket. The coil shoulder lifting plate lifts the rolled stock, wound into a coil to such an extent, that it can be moved out of the reeling basket.

In a particular arrangement, the rolled stock coil is shifted off the raised coil shoulder lifting plate of the reeling device by a kick-off arrangement in steps up to a coil conveyor belt. Several different arrangements are required for delivery and transfer of reeled coils from two reeling devices onto a coil conveyor belt. Thus, for instance, two pairs of kick-off devices for conveying the coils from the center of the reeling device to the center of the intermediate station, two pairs of kick-off devices for conveying the rings from the center of the intermediate station to the center of the coil conveyor belt, a lifting table in the region of the coil conveyor belt, a special plate coating in the region between the reel-up device and the coil conveyor belt so that the bottom windings of the coil will not be damaged during conveyance.

A disadvantage of kicking reeled coils onto a coil conveyor belt is that several separate devices are required (kickoff device, elevating tables or lifting tables, special plate coating). Also, damage to the surface of the bottom windings during the kickoff process caused by rough or damaged surfaces of the plate coating or through plate bulging because of temperature effects can occur in the conveyance region of the coils after an extended production period. Furthermore, individual windings or rod tips between the upper edge of the plate covering and the bottom edge of the kickoff device can jam especially in the case of thin round material. Since four kickoff devices intergrip during their movements, there exists also collision danger in case of faulty electrical control.

In another particular arrangement, the rolled stock coil is delivered from the raised lifting plate of the reel-up device in steps by walking beams and lifting or elevating tables onto a coil conveyor belt. For delivery and transfer of the wound coils from two reel-up devices onto one coil conveyor belt, several different arrangements are required. For instance, two walking beam conveyors, comprising a fixed grate and of mobile twin support arms for stepwise conveyance of the coils from the center of the reel-up device to the center of the fixed depositing grate. From there to the center of the lifting table, which simultaneously corresponds to the center of the coil conveyor belt. Thus, two lifting tables are required for accepting and depositing the reeled-up coils from the walking beam to the coil conveyor belt. The disadvantage of this known method is that, with two reel-up devices, four arrangements are required (two walking beam conveyors, consisting of mobile and fixed grates and two lifting tables). There exists further the danger of upsetting possibly production losses having to remove scrap because of repeated pickup and deposit of reeled coils. Several arrangements interrelated in a conveyance function constitute interfaces, which cannot always be closed by covering or deactivated by guide plates. Therefore, disturbances in the production sequence can occur. Furthermore, damage of rolled stock is possible. The reason for this is seen in relative motion of the bottom windings during contact with the conveyance arrangement caused by frequent pickup and deposit of the coils during the conveyance process. The plurality of conveyance arrangements disposed in the tightest space make maintenance more difficult resulting in increased costs.

Finally, in yet another arrangement, for delivery and conveyance of reeled-up coils from a reel-up device to a coil conveyor belt by means of walking beams, stationary pieces of roller track and a liftable and lowerable piece of roller track are used. Several different arrangements are required for delivery and transfer of the reeled-up coils from two reel-up devices onto one coil conveyor belt, namely two walking beam conveyors consisting of a fixed grate and movable twin support arms, for a stepwise conveyance of the coils from the center of the reel-up device to the center of the stationary piece of roller track. Furthermore, two stationary pieces of roller track with powered rollers for conveying the coils to the center of the liftable or raisable and lowerable piece of roller track is required. Additionally, a raisable and lowerable piece of roller track with powered rollers is required for acceptance and depositing of the reeled-up coils on the center of the coil conveyor belt. Herein, it is disadvantageous that several arrangements are required (two walking beam conveyors consisting of fixed and movable grates, two stationary pieces of roller track with powered rollers and one raisable and lowerable piece of roller track with powered rollers).

Because of the repeated pickup and depositing and because of the additional conveyance of the reeled-up coils, there exists the danger of upsetting the coils and possibly losses of production due to removal of scrap. Similar arrangements in conveyance interrelationships with each other from interfaces, which cannot always be closed by coverings or deactivated by guide plates. Interferences in the production sequence can therefore not be excluded. Since relative movement between the bottom windings and the conveyance rollers can occur, especially if the roller surfaces are damaged, additional surface damage of the rolled stock can occur during conveyance on roller tracks. With thicker round rolled stock, conveying problems can occur upon the roller tracks in that a rod tip located at the bottom of an already partially cooled coil hooks up at for instance a roller, a guide plate or a roller track frame.

An older solution for continuous deposition and conveyance of drawn wire is described in DE 1 294 907 Al. The wire coils falling off a drawing drum, one after the other, are diverted into a centering position by a deflection device attached to the drawing drum and are recaptured by a rotating receiving basket which comprises a disk-shaped base plate and a central core standing upright towards the top, around which the coils are dropped or fall. The basket is located on a table which is rotatably supported on low friction bearings upon the frame of a wheeled trolley. Such a depositing and conveyance arrangement for wire coils cannot be used in modern rolling mills with rolling speeds of 90 m/sec and because of other evident disadvantages.

A device for continuous formation of reeled-up wire coils and their conveyance is shown in DE 1 182 192 Al, wherein a rotary table for coil formation is disposed on a roller track. The wire coming from a suspended drawing block is wound upon a platform around an upright cylindrical core. The platform is conveyed upon the roller track to the rotary table. When the coil formation is terminated, the platform is conveyed from the rotary table to the portion of the roller track which continues the conveyance. This winding and conveying arrangement for wire coils cannot be used in rolling trains with the currently high rolling speeds and high throughputs.

SUMMARY OF THE INVENTION

To overcome many of these and other objects of the previously known devices, an apparatus for conveying rolled stock wound into coils in the reeling installation area is disclosed, wherein reeling and conveyance apparatus are installation components of a rolling mill having a single or several rolling lines for wire, light section steel or medium section steel, essentially comprising a furnace installation for the rolling material used, as well as a break-down train, intermediate train, and, if necessary, finishing train for the rolling stock.

The invention provides a delivery and transfer arrangement having defined features, wherein the rolled stock coil wound in a reel-up device can be delivered free of damage from the reel-up device and can be transferred without any damage on a downstream or following conveyance arrangement and which permits using the shortest cycling time by optimum allocation of reel-up devices and downstream conveyance device or devices. Also, the device is meant to assume a buffer function in case of possible installation malfunctions in the rolling train or rolling mill.

The delivery and transfer arrangement is provided with a support panel for the reeled-up rolled stock coils which can be swiveled in a carousel-like manner and can be raised, as well as horizontally displaced and with one or several reel-up reeling devices and with one or several conveyance devices disposed in the peripheral regions of the swiveling range of the support panel. Herein, the delivery of a reeled coil from a reeling device for transfer to a conveyance arrangement located downstream, is performed without any damage, since the coils must not be picked-up and deposited several times and also because no kick off of reeled coils are conveyed without bumps or shocks in a rotating manner from the center of the reel-up device onto belt positions wherein upsetting of the coil caused by conveyance shocks can be excluded. Furthermore, one of the conveyance arrangements can serve as an independent buffer or for cooling of warm rolled stock coils.

In a refinement of the invention, the support panel is connected to a perpendicularly disposed lifting cylinder located on a displaceable or movable frame, wherein the movable frame or bogie is connected with a horizontal rotary part or bogie. Thus, only one single device can be used instead of several transfer arrangements in the previously known designs. The compact construction affords increased accessibility for the maintenance and diminishes the interlocking or latching conditions of the devices among themselves. Fewer interfaces during the operation of the conveyance arrangement result also in higher operating safety.

In another refinement of the invention, a ball-type turntable is used between the horizontal rotary part or bogie and a machine base connected to the foundation so than an optimum allocation of reel-up devices with, following thereon, conveyance arrangement or arrangements and the overlap of motion sequences is achieved among other items so that a time saving coil conveyance occurs and thereby short cycle times are made possible.

It is proposed in a further development of the invention, that the horizontal bogie can be connected with a drive unit possibly provided with a gear box which is preferably disposed at the machine base and whose drive pinion meshes with an angularly shaped ring gear of the bogie. This means a simplified control and locking condition for the swiveling motions of the delivery and transfer device. A lifting cylinder is expediently connected with a traveling trolley for reduction of the number of drives of the arrangement, whose traveling rollers travel on rails, wherein the traveling rails are disposed in a housing connected with a horizontal bogie and the traveling trolley can be moved by a displacement device, preferably by a piston cylinder unit at the housing. The compact construction results also in a considerably simplified foundation design which can be fabricated in an economic manner. In another refinement of the invention, foundation design of the arrangement permits this arrangement to be supplied with electric current and a hydraulic pressure medium by means of a rotary distributor disposed in the center of the rotational axis of the horizontal bogie.

Significant weight is expediently obtained by surrounding the lifting piston of the lifting cylinder by a cylindrical guide sleeve connected with the traveling trolley. The sleeve is embraced by the lifting pipe gliding coaxially along the guide sleeve. The pipe is connected to a lifting piston. This achieves a stable light construction, where simple sheet metal plates can be utilized and also high stability and permits the connection of the support panel with the top end face of the lifting pipe. The panel, if necessary, may comprise extendable support arms for the reel-up rolled stock coils.

In another embodiment of the invention, the stroke of the support panel of the lifting stroke of the lifting cylinders corresponds at least to the height difference between the delivery position of the rolled stock coils from the respective reel-up device and the transfer position of the conveyance device or devices.

BRIEF DESCRIPTION OF THE DRAWINGS

The invention will be better understood, by the DETAILED DESCRIPTION OF THE PREFERRED EMBODIMENT, in connection with the drawings, of which.

DETAILED DESCRIPTION OF THE PREFERRED EMBODIMENT

Figure 1:
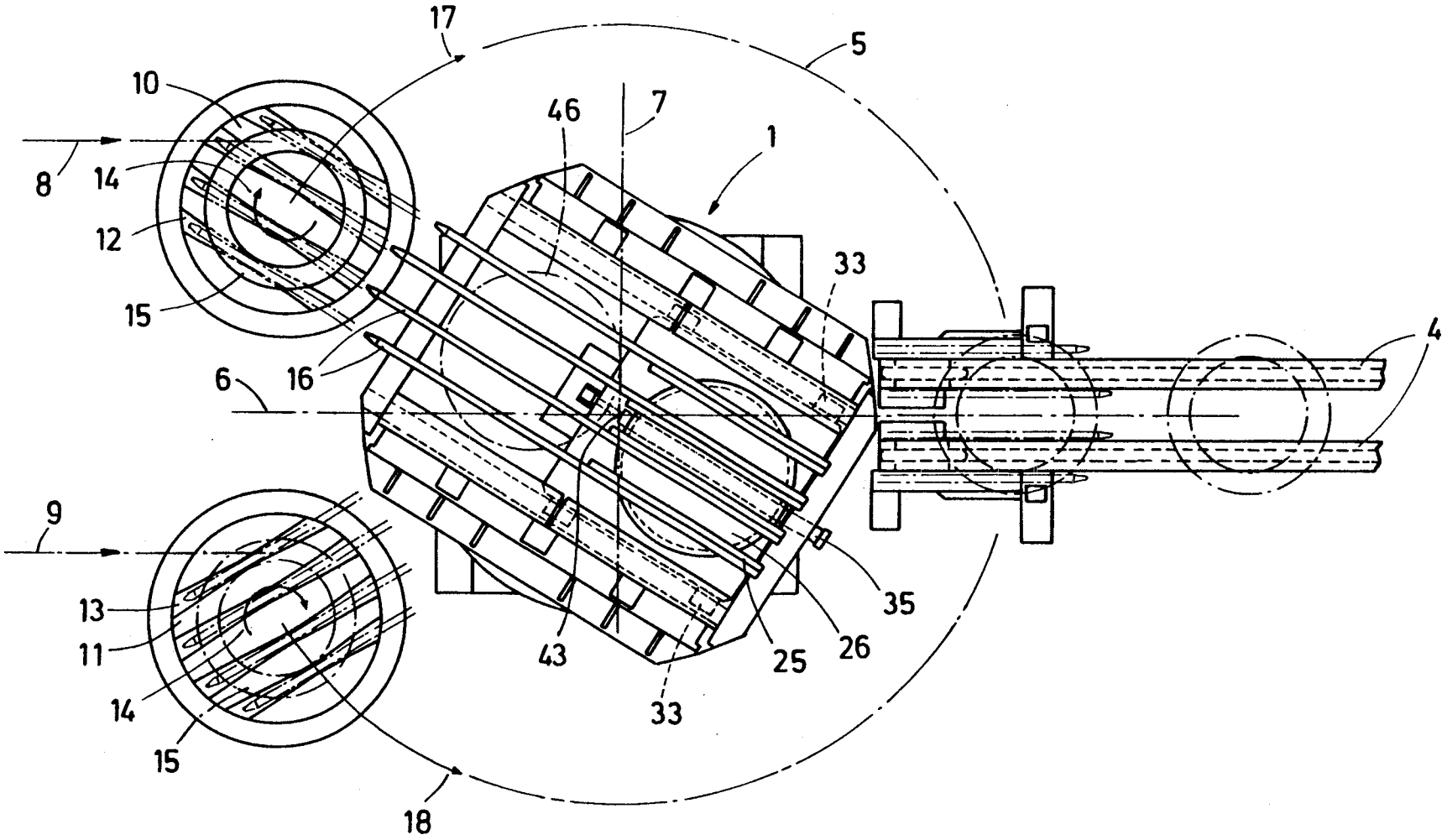
FIG. 1 is a plan view of the delivery and transfer arrangement with peripherally disposed reel-up devices and a conveyance device.

Referring now to the drawings, wherein like numerals reflect like elements throughout both Figures, FIG. 1 shows a plan view of the delivery and transfer arrangement 1, between two rotary basket reeling or coil winding devices and a conveyance arrangement 5, in this case, a conveyor belt. The rotary basket reeling devices and the conveyor belt are located in the peripheral region 5 of the swiveling movement of the device 1. The swiveling movement of the device 1 can be defined along the principal coordinates 6, 7. In the rotary reeling devices, only the rolled stock entry guides 8, 9 are shown, as well as the liftable plates 10, 11 with the longitudinal grooves 12, 13 embedded into the plate bottom. The rotational direction of the respective reeling devices is designated by the rotational arrow. The rolled stock coil 15, wound in a reel-up device, lies or rests upon the lifting plate 10, 11.

The pick-up and delivery of the rolled stock coil 15 in the region of the center of the coiling devices 2,3 and the transfer of the rolled-stock coil to the center of the conveyor belt 4 occurs by lifting and lowering of the support arms 16 of the device 1, as well as by swiveling the device 1 in direction of the arrows 17, 18, wherein the movements lifting/swiveling and lowering/swiveling overlap each other in order to shorten the time period for one conveyance cycle. The delivery and transfer arrangement 1 is designed in a particular manner for performing these motion sequences, as discernable from FIG. 2.

Figure 2:
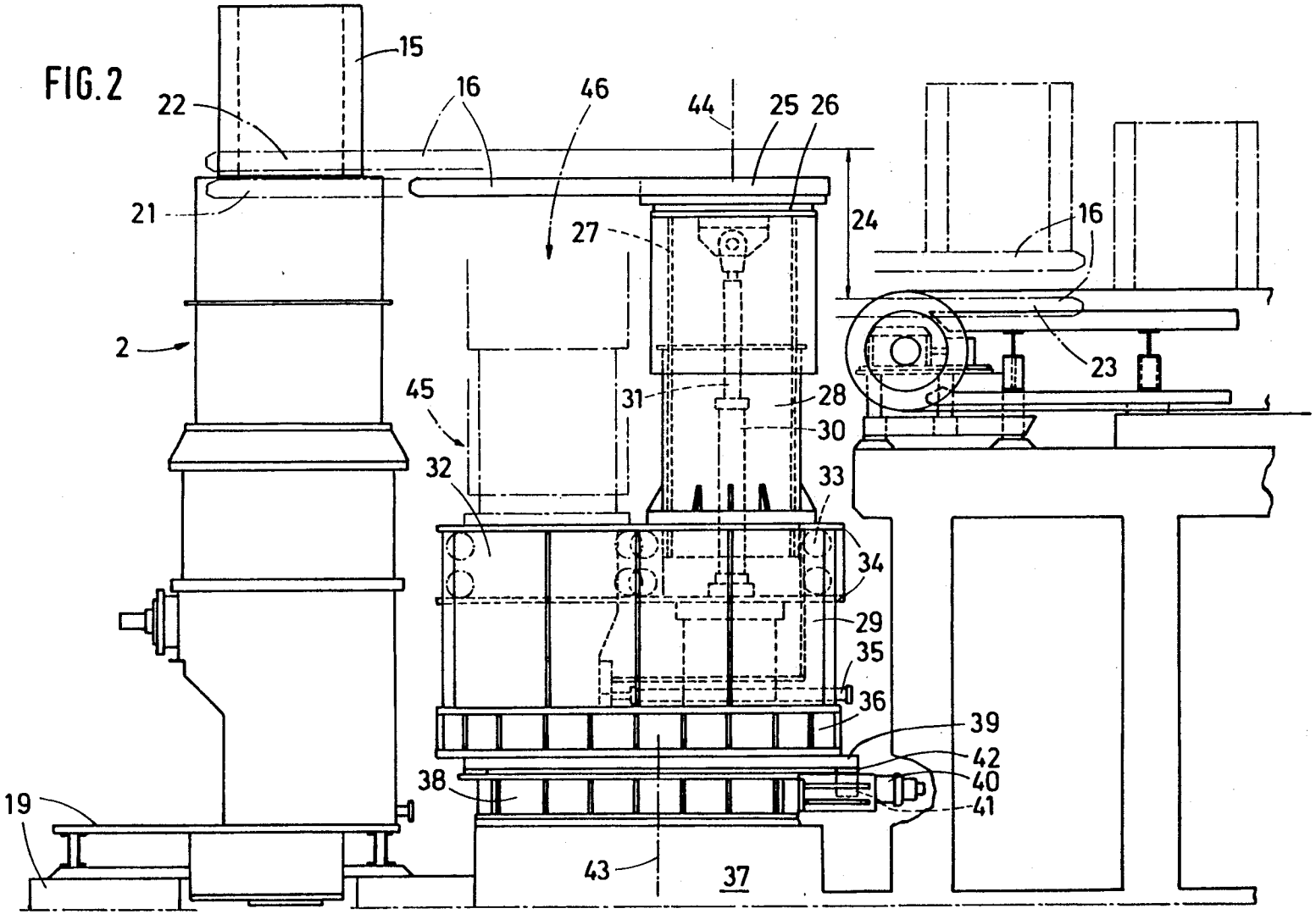
FIG. 2 is a side view of the delivery and transfer arrangement of FIG. 1 with different delivery and transfer positions between the reel-up device and conveyance arrangement.

FIG. 2 depicts the rotary basket reeling device 2 with the rolled stock coil 15 lifted out of the reel and located upon the lifting plate. The support arms 16 of the arrangement 1 move into the longitudinal grooves 12 in the lifting plate and are thus in the receiving position 21 for the rolled stock coil. FIG. 2 shows also the conveyor belt 4, namely a conveyor chain and the transfer position 23 of the rolled stock coil upon the conveyor belt. The support arms 16, which have taken over the rolled stock coil 15, are in the transfer position 23 in the longitudinal apertures between the conveyor chins beneath their upper edge. Between the delivery position 22 of the rolled stock coil, meaning the position in which the support arms 16 of the arrangement 1 are lifted out of the longitudinal grooves 12 in the lifting plate 10 of the reel-up device to above the top edge of the lifting plate and the transfer position 23, a height difference must be bridged which corresponds at least to the stroke 24 of the arrangement 1. The rotary basket reel-up 2 and conveyor belt 4 are abutted upon the foundation construction 19, 20.

The delivery and transfer arrangement contains a liftable, as well as horizontally displaceable support panel 25, which can also be swiveled in a carousel-like manner, to which supports panel, the support arms 16 are fastened. The support arms 16 can, if necessary, be configured to be extendable. The support panel 25 is connected to the top end face 26 of a lifting pipe 27. The lifting pipe 27 slides coaxially along a cylindrical guide sleeve 28 connected with the upper edge of a traveling trolley 29. A lifting cylinder 30 is furthermore arranged in the traveling trolley 29, whose lifting piston 31 is connected with the lifting pipe 27 and thus with the support panel 25. The lifting piston and the support panel can be lifted and lowered by introduction of a hydraulic pressure medium into the lifting cylinder 30. The traveling trolley 29 is in a housing 32 and is equipped with top and bottom traveling rollers 33 which are guided, in a constrained manner in the traveling rails 34, for which reasons the tope and bottom traveling rails can be respectively bent in a u-shaped manner. For balancing reasons, the lifting cylinder, with its lifting pipe, is disposed approximately in the center of gravity region of the traveling trolley. The traveling trolley 29 is moved horizontally in the housing 32 by a displacement arrangement 35, preferably configured as a piston cylinder unit and abutted at the housing 32. The housing 32, together with traveling trolley 29, is connected to a horizontal bogie 36.

Between the horizontal bogie and a machine base 38, connected to the foundation 37, is a ball-type turntable 39. The horizontal bogie 36 is connectable to a drive unit 40, if necessary, provided with a gear box, which is preferably disposed at the machine base 38 and whose drive pinion 41 meshes with an angularly shaped crown gear toothed ring 42 of the bogie 36. The supply of the delivery and transfer apparatus 1 with electrical energy, for instance, for the drive unit 40 and with a hydraulic pressure medium, for instance, for the lifting cylinder 30, is performed by a known rotary distributor (not shown) disposed in the center of the axis of rotation 43 of the horizontal bogie 36. Two traveling positions 44, 45 of the traveling trolley 29 are shown in the apparatus housing 32 of the delivery and transfer apparatus 1. Traveling position 44 indicates the waiting position "center lifting pipe" upstream of the reeling arrangement 2. Traveling position 45 indicates the waiting position "center lifting pipe" upstream of the conveyor belt 4.

According to FIGS. 1 and 2, the traveling trolley 29 is moved out of its waiting position 44, upstream of the reel-up arrangement 2, by the displacement apparatus 35, in direction of the reel-up arrangement 2, whereby the support arms 16 travel below the rolled stock coil 15, upon the lifting plate 10 of the reel-up arrangement. The lifting pipe 27 and, with the support panel 25 with the support arms 16, is lifted to such an extent by operating the lifting cylinders 30, that the support arms 16 now come to be positioned above the upper edge of the lifting plate 10. Then the horizontal bogie 36, upon which the apparatus 1 rests, is swiveled by the drive unit 4 in the principal coordinate system 7 in the direction of the arrow 17 towards the conveyor belt. The traveling trolley 29 thus is in the traveling position 46 (see FIG. 2). Through operation of the lifting cylinder 30, the lifting pipe and the connected support panel, as well as the support arms 16, are lowered into the waiting position 45. Subsequently, the traveling trolley 4 is moved into the transfer position 23.

If the rolled stock coil 15 is deposited upon the conveyor belt 4, there occurs a further slight lowering of the support arms caused by the lifting cylinder so that the rolled stock coil rests freely upon the conveyor belt and can be further conveyed. The accessing of all remaining positions along the principal coordinates system 6, 7 occurs in identical or similar travel sequences as those previously described, wherein the support panel for the wound rolled stock coils can be swiveled in a carousel-like manner due to the inventive design of the delivery and transfer apparatus, the support panel being liftable, as well as horizontally displaceable, wherein the individual movements can occur separately or in an overlapping manner. The initially defined task, especially the damage free conveyance of the wound rolled stock coils is thus solved in a ideal manner by the delivery and transfer apparatus designed according to the invention.

While the preferred and alternate embodiments of the invention have been disclosed in detail, variations and modifications may be made thereto without departing from the spirit and scope of the invention, as defined in the following claims:

What is claimed is:

1. An apparatus for delivering of coils of rolled stock from a reel-up device and for transferring the rolled stock coils onto a conveyance device, said apparatus comprising:

a liftable and horizontally swivelable support panel for receiving the rolled stock coils;

at least one transporting device arranged in the peripheral region of the horizontal swiveling path of the support panel for transporting the rolled stock coils to the conveyance device;

a cylinder for lifting the support panel from a coil transporting position to a coil receiving position thereof;

a traveling trolley for supporting the lifting cylinder and having traveling rollers;

a housing for the traveling trolley;

rail means arranged in the housing for guiding the traveling trolley and engageable by the traveling rollers of the traveling trolley;

displacement means supported in the housing for displacing the traveling trolley; and a horizontal bogie for supporting the housing.

2. The apparatus of claim 1, wherein said displacement means comprises a piston-cylinder unit.

3. The apparatus for claim 1, further comprising a machine base to be supported on a foundation, and a ball turntable arranged on the machine base for supporting the horizontal bogie.

4. The apparatus of claim 3, further comprising drive means provided on the machine base for moving the bogie, the bogie having an annular ring with an internal toothing, and wherein said drive means includes a driving pinion for engaging the toothing of the annular ring.

5. The apparatus of claim 1, wherein the rail means comprises spaced upper and lower rails, and the traveling rollers of the traveling trolley comprises upper and lower rollers engaging the upper and lower rails, respectively.

6. The apparatus of claim 1, further comprising a lifting pipe connected to the support panel, and a cylindrical guide sleeve supported on the traveling trolley for guiding the lifting pipe, thereon, said cylinder including a piston extending in the guide sleeve and connected with the lifting pipe.

7. The apparatus of claim 1, wherein the support panel comprises extendable support arms for receiving the rolled stock coils form the reel-up device.

8. The apparatus of claim 1, wherein the lifting cylinder has a lifting stroke which equals at least to a height difference between a location of the reel-up device and a location of the conveyance device.

9. The apparatus of claim 1, further comprising a rotary distributor arranged about a central axis of the bogie for supplying electrical energy and hydraulic pressure medium necessary for operation of the apparatus.

* * * * *